US005496123A

United States Patent [19]

Gaither

[11] Patent Number: 5,496,123

[45] Date of Patent: Mar. 5, 1996

[54] SELF-LOADING PAINT APPLICATOR GUN

[76] Inventor: Charles E. Gaither, 2982 Martha Dr., Ventura, Calif. 93003

[21] Appl. No.: 235,860

[22] Filed: May 2, 1994

[51] Int. Cl.[6] ..... A46B 11/02

[52] U.S. Cl. ..... 401/176; 401/180; 401/270; 401/279; 401/287; 401/140

[58] Field of Search ..... 401/176, 180, 401/270, 279, 289, 287, 140

[56] References Cited

U.S. PATENT DOCUMENTS

| | | | |
|---|---|---|---|
| 352,009 | 11/1886 | Seery | 401/289 |
| 1,644,356 | 10/1927 | Rogers | 401/176 X |
| 1,960,071 | 5/1934 | Tange | 401/279 |
| 2,509,954 | 5/1950 | Barnes et al. | 401/180 X |
| 3,175,242 | 3/1965 | Kamondy et al. | 401/180 |

FOREIGN PATENT DOCUMENTS

| | | | |
|---|---|---|---|
| 552347 | 6/1932 | Germany | 401/180 |

*Primary Examiner*—Steven A. Bratlie

[57] ABSTRACT

A self-loading paint applicator gun for painting comprising a hollow stock adapted to receive a paint cartridge filled with paint; a valve mechanism disposed in the stock for receiving a paint cartridge and allowing the flow of paint from the paint cartridge in an opened orientation and preventing the flow of paint in a closed orientation; a trigger linkage mechanism for placing the valve mechanism in the opened orientation or the closed orientation; a hollow butt coupled to the stock; a plunging mechanism disposed within the butt for applying a force for allowing paint to flow from a paint cartridge; a barrel having a base end coupled to the stock and a tip end extended therefrom; a transfer hose having a base end and tip end with the base end coupled to the valve mechanism; and a brush having a handle on one end coupled to the tip end of the barrel, bristles on the other end, and a hollow and perforated sash therebetween coupled to the tip end of the transfer hose; whereby when a paint cartridge is disposed in the stock and a plunging force is applied to the plunger, paint from the paint cartridge flows through the valve mechanism, transfer hose, and sash of the brush to wet the bristles of the brush for painting.

2 Claims, 4 Drawing Sheets

SELF-LOADING PAINT APPLICATOR GUN

BACKGROUND OF THE INVENTION

1. Field of the Invention

The present invention relates to a self-loading paint applicator gun and more particularly pertains to painting the edges between walls and ceilings with a self-loading paint applicator gun.

2. Description of the Prior Art

The use of paint applicator devices is known in the prior art. More specifically, paint applicator devices heretofore devised and utilized for the purpose of painting objects are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,462,231 to Pomares discloses a paint applicator. U.S. Pat. No. 3,603,694 to Hamm discloses a device for feeding paint to a painting brush. U.S. Pat. No. 3,676,010 to Kirch discloses an applicatory-liquid feeding and applying apparatus. U.S. Pat. No. 4,971,470 to Moeck et al. discloses an applicator device for viscous material. U.S. Pat. No. 5,071,278 to Chen discloses a self-feeding paint brush.

While these devices fulfill their respective, particular objective and requirements, the aforementioned patents do not describe a self-loading paint applicator gun that utilizes paint cartridges in a gun-like applicator for painting.

In this respect, the self-loading paint applicator gun according to the present invention substantially departs from the conventional concepts and designs of the prior art, and in doing so provides an apparatus primarily developed for the purpose of painting the edges between walls and ceilings.

Therefore, it can be appreciated that there exists a continuing need for new and improved self-loading paint applicator gun which can be used for painting the edges between walls and ceilings. In this regard, the present invention substantially fulfills this need.

SUMMARY OF THE INVENTION

In the view of the foregoing disadvantages inherent in the known types of paint applicator devices now present in the prior art, the present invention provides an improved self-loading paint applicator gun. As such, the general purpose of the present invention, which will be described subsequently in greater detail, is to provide a new and improved self-loading paint applicator gun and method which has all the advantages of the prior art and none of the disadvantages.

To attain this, the present invention essentially comprises, in combination, a stock. The stock includes a rigid and generally tubular stock housing having a threaded base end, a threaded tip end, an elongated and generally tubular cartridge cavity extended from the base end to the tip end, and a linkage cavity extended below the cartridge cavity. The stock includes a trigger pivotally coupled to the stock housing near the base end, extended through the linkage cavity, and terminated at a location exterior to the stock housing. The stock includes a hand grip extended from the stock housing between the trigger and the base end with the hand grip adapted for allowing a user a firm grip. The stock includes a trigger protector extended around the trigger from the hand grip to the stock housing. The stock includes a funnel-shaped cartridge receiver having a radially extended portion disposed in the cartridge cavity and a radially retracted portion disposed in the linkage cavity. The stock includes a generally elongated and tubular paint cartridge disposed in the cartridge cavity with the paint cartridge having a hollow and conical tip extended from one end into the cartridge receiver, a seat slidably disposed therein at the other end, and paint disposed therein between the seat and tip with the paint adapted to exit the cartridge from the tip end when a plunging force is applied to the seat. The stock includes a tip sealing ring coupled within the cartridge receiver and disposed around the tip of the paint cartridge for preventing paint from leaking into the cartridge cavity. The stock includes an elongated valve assembly disposed in the linkage cavity with the valve assembly having a base end and a tip end with the base end coupled to the radially retracted end of the cartridge receiver, the valve assembly further having an opened orientation for allowing the flow of paint through the cartridge receiver and a closed orientation for preventing the flow of paint through the cartridge receiver. Lastly, the stock includes a trigger linkage extended within the linkage cavity between the trigger and the valve assembly with the trigger linkage having one position for placing the valve assembly in the opened orientation when the trigger is depressed towards the hand grip and another position for placing the valve assembly in the closed orientation when the trigger is released.

The present invention includes a butt. The butt includes an elongated and generally tubular butt housing having a threaded base end, a threaded tip end coupled about the base end of the stock housing, and a generally tubular plunger cavity extended from the base end to the tip end. The butt includes a plunger having a plunging head on one end, handle on the other end, and a plunging rod therebetween with the handle extended from the base end of the butt housing for applying a plunging force and the plunging head disposed within the plunger cavity for delivering the plunging force to the seat of the paint cartridge. The butt includes a sealing ring disposed between the plunging head of the plunger and butt housing for preventing paint from the paint cartridge from leaking into the plunger cavity. The butt includes an end cap threadably coupled to the base end of the butt housing and extended about the plunging rod for preventing the removal of the plunger from the plunger cavity. Lastly, the butt includes a spring disposed within the plunger cavity between the plunging head of the plunger and end cap for urging the plunger towards the seat of the paint cartridge.

The present invention includes a barrel assembly. The barrel assembly includes a first barrel having a threaded base end and a threaded tip end with the base end threadably coupled to the tip end of the stock housing and the tip end further having a stop ring peripherally extended therefrom. The barrel assembly includes a second barrel having a base end and a slotted tip end with the base end telescopically received in the tip end of the first barrel. The barrel assembly includes a barrel adjustment nut threadably coupled to the tip end of the first barrel and disposed about the base end of the second barrel with the barrel adjustment nut further including a coupling ring disposed therein with the coupling ring adapted to expand inwards to secure the second barrel in a fixed position when the barrel adjustment nut is tightened against the stop ring of the first barrel. The barrel assembly includes a flexible transfer hose having a base end coupled to the tip end of the valve assembly, an intermediate portion extended within the first barrel and the second barrel, and a tip end extended from the tip end of the second barrel. The barrel assembly includes a protective sheath disposed about the transfer hose with the sheath having bellows formed thereon for preventing the transfer hose from being kinked and damaged when the second barrel is extended away from the first barrel and retracted towards the first barrel. Lastly, the barrel assembly includes a elongated barrel handle having a first end coupled to the first barrel and a second end with a grip formed thereon.

Lastly, the present invention includes a brush. The brush includes an elongated sash having a beveled nozzle extended therefrom and coupled to the tip end of the transfer hose, a plurality of generally aligned and spaced supply tubes extended therefrom in a direction remote from the nozzle, and a channel disposed therein between the nozzle and the supply tubes. The brush includes a plurality of bristles extended from the sash, disposed around the supply tubes, and terminated at a location remote from the sash to define a tapered end. The brush includes a first mounting bracket coupled to the tip end of the second barrel with the bracket having a mounting hole disposed therethrough. The brush includes a second mounting bracket coupled to the sash near the nozzle thereof with the bracket having a mounting hole disposed therethrough. The brush includes a bolt disposed through the mounting hole on the first mounting bracket and mounting hole on the second mounting bracket. Lastly, the brush includes a wing nut coupled to the bolt for securing the first mounting bracket and second mounting bracket at a given position and thereby allowing the angular orientation of the bristles to be changed. When a plunging force is applied to the plunger, paint from the paint cartridge flows through the cartridge receiver, valve assembly, transfer hose, and sash to wet the bristles for painting.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved self-loading paint applicator gun which has all the advantages of the prior art paint applicator devices and none of the disadvantages.

It is another object of the present invention to provide a new and improved self-loading paint applicator gun which may be easily and efficiently manufactured and marketed.

It is a further object of the present invention to provide a new and improved self-loading paint applicator gun which is of durable and reliable construction.

An even further object of the present invention is to provide a new and improved self-loading paint applicator gun which is susceptible of a low cost of manufacture with regard to both materials and labor, and which accordingly is then susceptible of low prices of sale to the consuming public, thereby making such a self-loading paint applicator gun economically available to the buying public.

Still yet another object of the present invention is to provide a new and improved self-loading paint applicator gun which provides in the apparatuses and methods of the prior art some of the advantages thereof, while simultaneously overcoming some of the disadvantages normally associated therewith.

Even still another object of the present invention is to provide a new and improved self-loading paint applicator gun for painting the edges between walls and ceilings.

Lastly, it is an object of the present invention to provide a new and improved self-loading paint applicator gun comprising a hollow stock adapted to receive a paint cartridge filled with paint therein; valve means disposed in the stock for receiving a paint cartridge, allowing the flow of paint from a paint cartridge in an opened orientation, and preventing the flow of paint from a paint cartridge in a closed orientation; trigger linkage means for placing the valve means in the opened orientation and the closed orientation; a hollow butt coupled to the stock; plunging means disposed within the butt for applying a force for allowing paint to flow from a paint cartridge; a barrel having a base end coupled to the stock and a tip end extended therefrom; a transfer hose having a base end and tip end with the base end coupled to the valve means; and a brush having a handle on one end coupled to the tip end of the barrel, bristles on the other end, and a hollow and perforated sash therebetween coupled to the tip end of the transfer hose; whereby when a paint cartridge is disposed in the stock and a plunging force is applied to the plunger, paint from the paint cartridge flows through the valve means, transfer hose, and sash of the brush to wet the bristles of the brush for painting.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
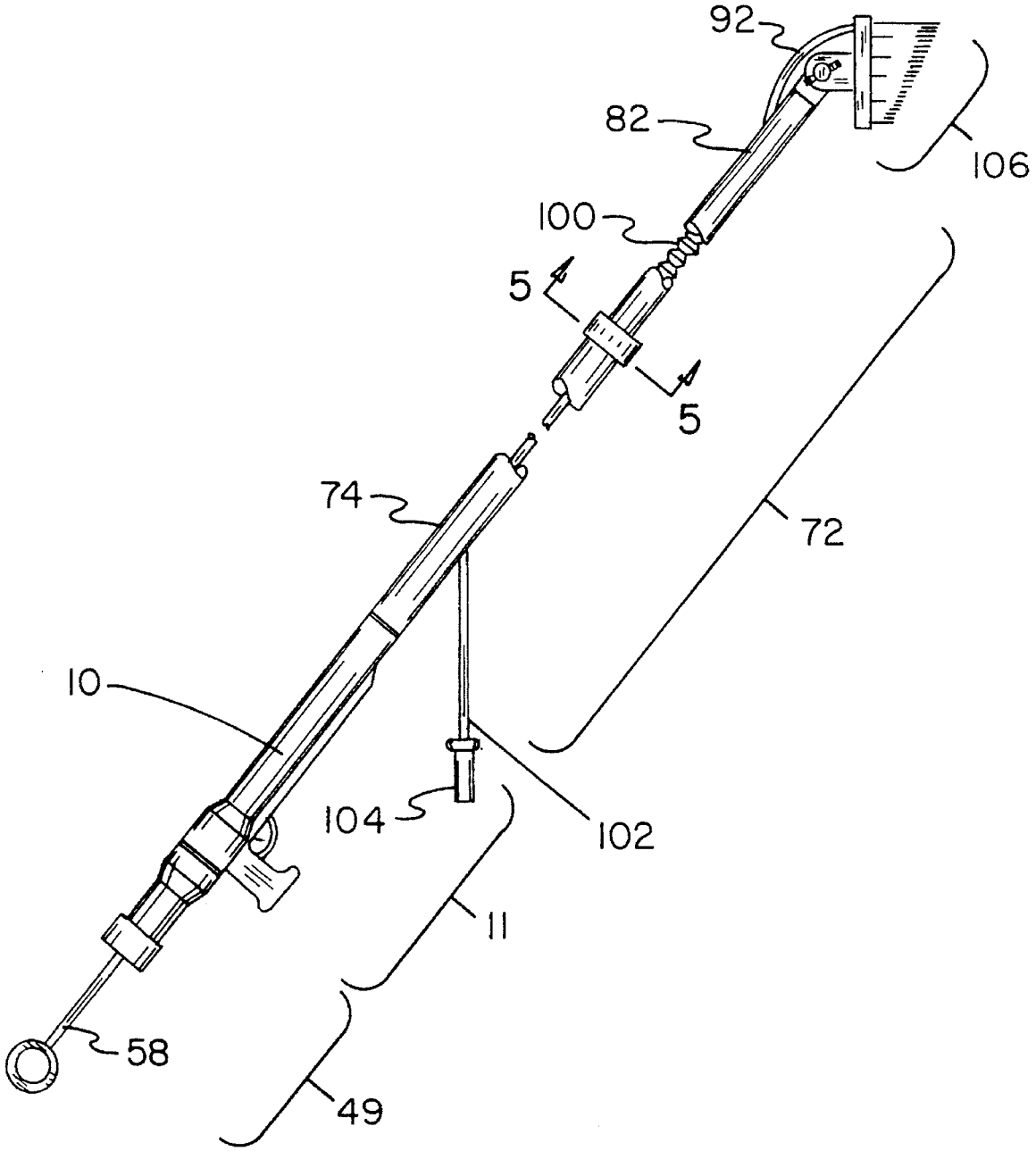
FIG. 1 is a cut-away view of the preferred embodiment constructed in accordance with the principles of the present invention.
Figure 2:
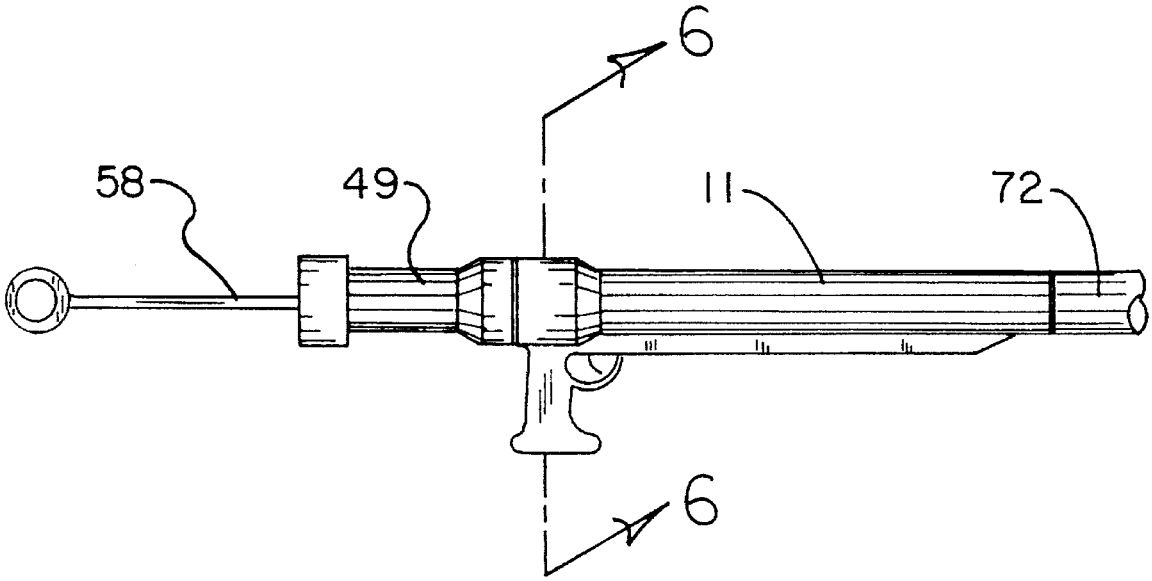
FIG. 2 is an enlarged view of the stock and butt of the present invention.
Figure 3:
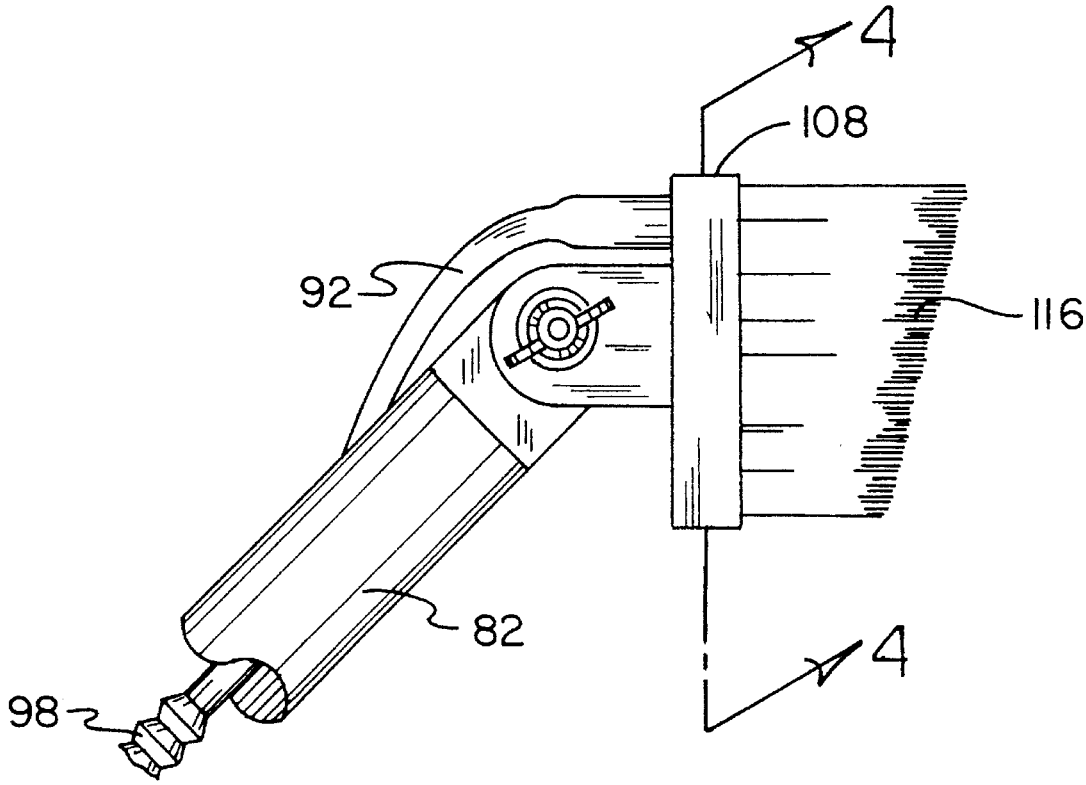
FIG. 3 is an enlarged view of the brush and coupling with the second barrel of the present invention.
Figure 4:
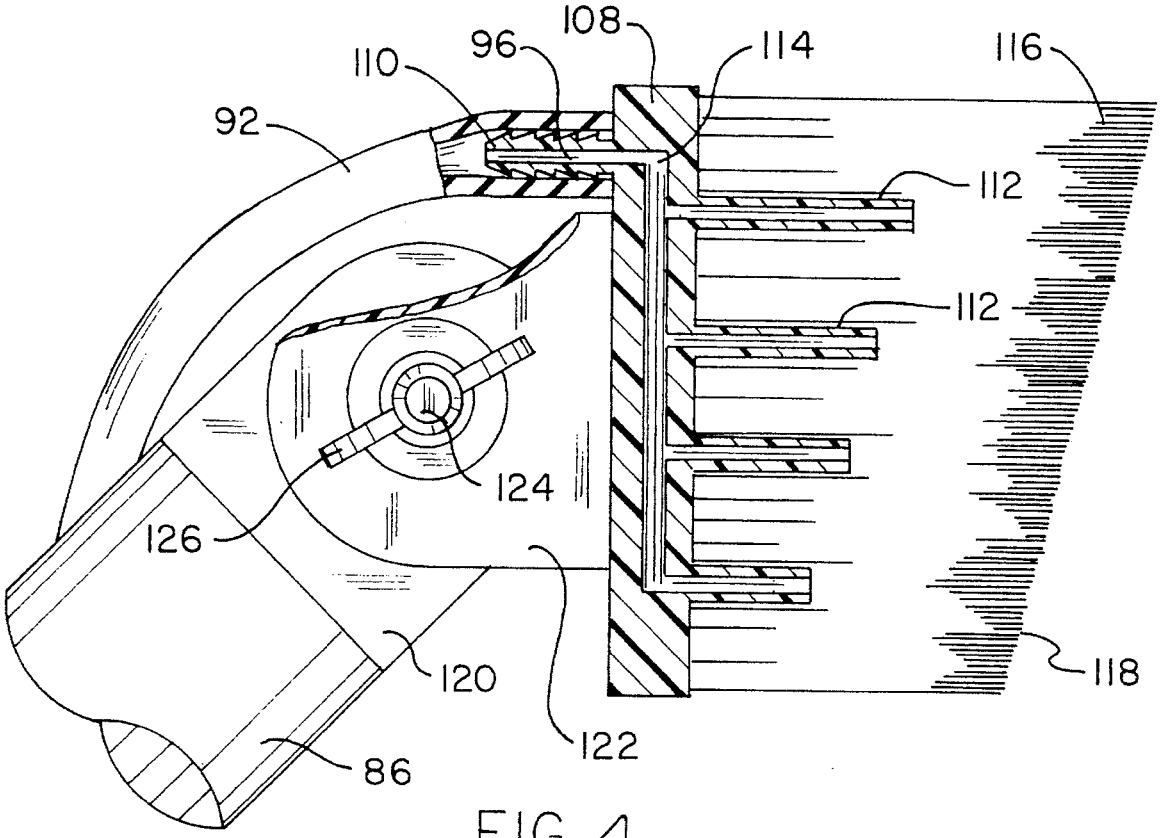
FIG. 4 is a cross-sectional view of the brush of the present invention.
Figure 5:
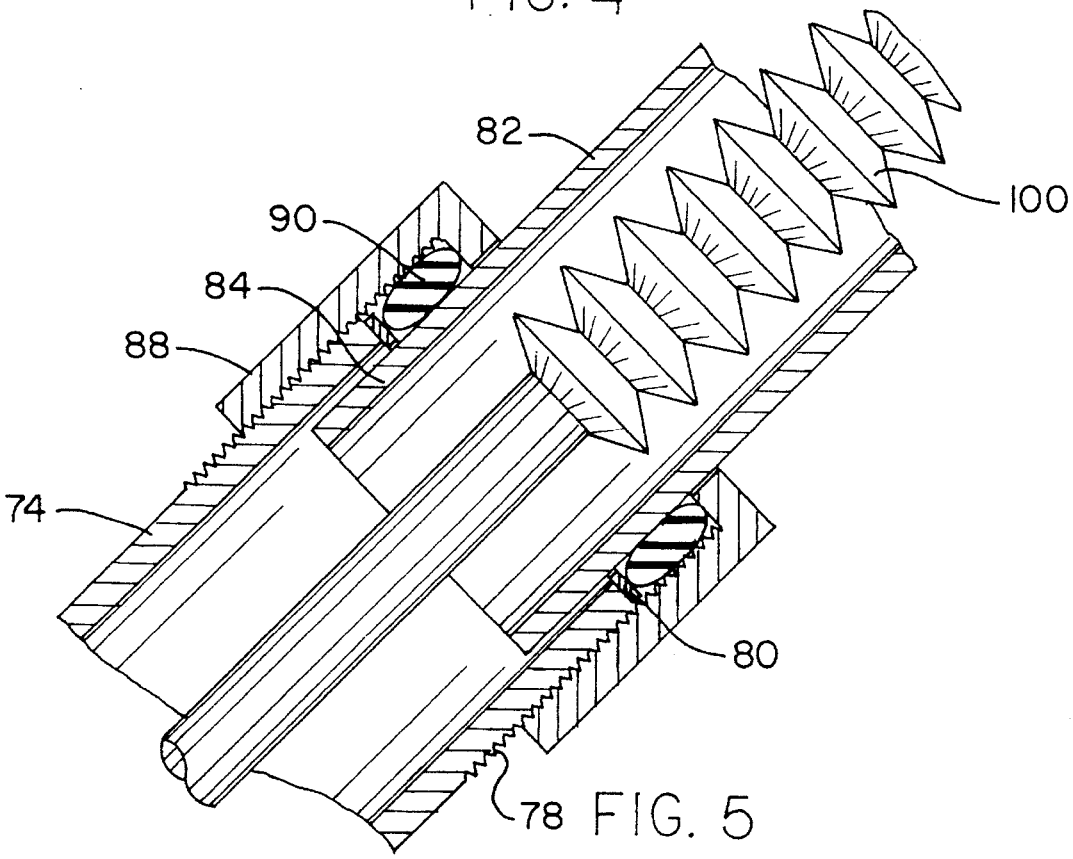
FIG. 5 is a cross-sectional view of the coupling between the first barrel and second barrel of the present invention taken along the line 4—4 of FIG. 1.
Figure 6:
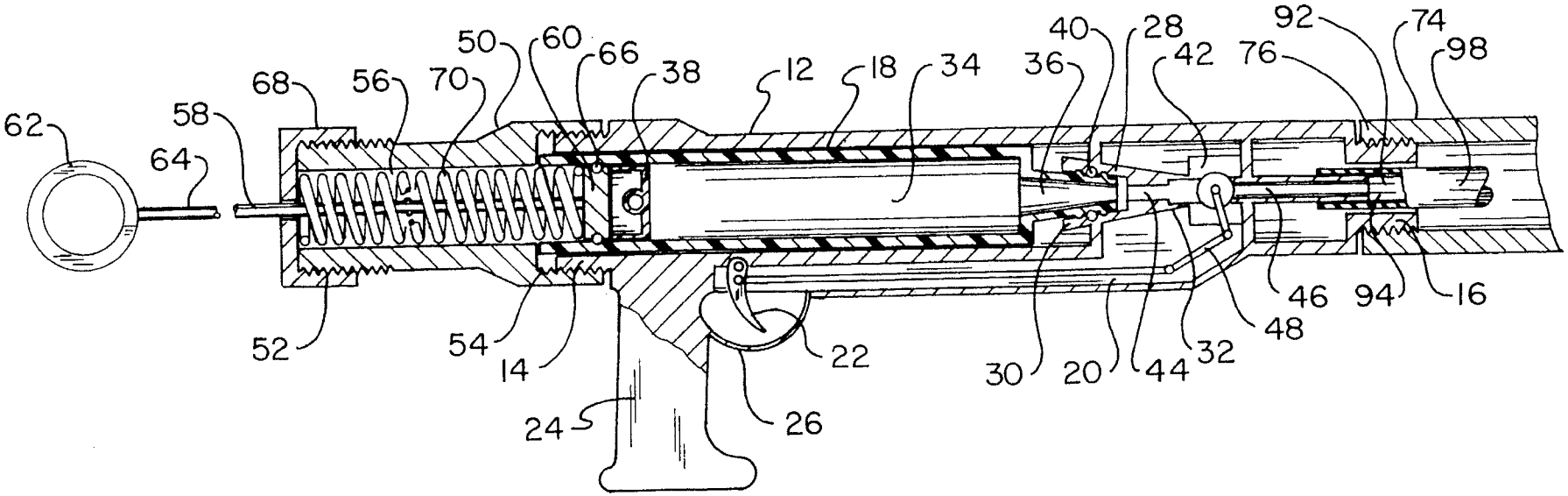
FIG. 6 is a cross-sectional view of the butt and stock of the present invention taken along the line 6—6 of FIG. 2.

With reference now to the drawings, and in particular, to FIG. 1 thereof, the preferred embodiment of the new and improved self-loading paint applicator gun embodying the principles and concepts of the present invention and generally designated by the reference number 10 will be described.

Specifically, the present invention includes four major components. The major components are the stock, butt, barrel assembly, and brush. These components are interrelated to provide the intended function.

More specifically, it will be noted in the various Figures that the first major component is the stock 11. The stock includes nine subcomponents. The subcomponents are the stock housing, trigger, hand grip, trigger protector, cartridge receiver, paint cartridge, tip sealing ring, valve assembly, and trigger linkage. These subcomponents are interrelated to provide the intended function.

The first subcomponent of the stock is the stock housing 12. The stock housing is rigid, elongated, and tubular in structure. It has a threaded base end 14 and a threaded tip end 16. An elongated and generally tubular cartridge cavity 18 is extended from the base end to the tip end. A linkage cavity 20 is extended below the cartridge cavity.

The second subcomponent of the stock is the trigger 22. The trigger is pivotally coupled to the stock housing 12 near the base end 14. It is extended through the linkage cavity 20. It is then terminated at a location exterior to the trigger housing. The trigger is adapted to be placed in contact and reciprocated with the trigger finger of a user.

The third subcomponent of the stock is the hand grip 24. The hand grip is extended from the stock housing 12 at a location between the trigger 22 and the base end 14. The hand grip is adapted for allowing a user a firm grip of the stock housing.

The fourth subcomponent of the stock is the trigger protector 26. The trigger protector is rigid in structure. It is extended around the trigger from the hand grip 24 to the stock housing 12. The trigger protector prevents inadvertent depression of the trigger.

The fifth subcomponent of the stock is the cartridge receiver 28. The cartridge receiver is funnel-shaped and rigid in structure. It has a radially extended portion 30 disposed in the cartridge cavity 18. It also has a radially retracted portion 32 disposed in the linkage cavity 20. The cartridge receiver is axially aligned with the cartridge cavity 18.

The sixth subcomponent of the stock is the paint cartridge 34. The paint cartridge is generally elongated and tubular in structure. It is disposed in the cartridge cavity 18. The paint cartridge has a hollow and conical tip 36 extended from one end into the cartridge receiver 28. The paint cartridge also has a seat 38 slidably disposed therein at the end remote from the tip. Paint is disposed within the paint cartridge between the seat and the tip. Paint is adapted to exit the cartridge from the tip end when a plunging force is applied to the seat. The paint cartridge may be adapted to be refilled or be disposable in design.

The seventh subcomponent of the stock is the tip sealing ring 40. The tip sealing ring is flexible in structure. It is coupled within the cartridge receiver 28 and disposed around the tip 36 of the paint cartridge. The tip sealing ring prevents paint from leaking into the cartridge cavity 18 when a plunging force is applied to the seat 38 of the paint cartridge.

The eighth subcomponent of the stock is the valve assembly 42. The valve assembly is elongated in structure. It is disposed in the linkage cavity 20. The valve assembly has a base end 44 and a tip end 46. The base end is coupled to the radially retracted end 32 of the cartridge receiver. The valve assembly is axially oriented with the cartridge receiver and cartridge cavity 18. The valve assembly has an opened orientation for allowing the flow of paint through the cartridge receiver 28 and a closed orientation for preventing flow of paint through the cartridge receiver.

The ninth subcomponent of the stock is the trigger linkage 48. The trigger linkage is composed of a plurality of links pivotally coupled together in end-to-end fashion. The trigger linkage is extended within the linkage cavity 20 between the trigger 22 and the valve assembly 42. The trigger linkage has one position for placing the valve assembly in the opened orientation when the trigger is depressed towards the hand grip 24. The trigger linkage also has another position for placing the valve assembly in the closed orientation when the trigger is released.

The second major component is the butt 49. The butt includes five subcomponents. The subcomponents are the butt housing, plunger, sealing ring, end cap, and spring. These subcomponents are interrelated to provide the intended function.

The first subcomponent of the butt is the butt housing 50. The butt housing is rigid, elongated, and generally tubular in structure. It has a threaded base end 52 and a threaded tip end 54. The tip end is coupled about the base end 14 of the stock housing. The butt housing also includes a generally tubular plunger cavity 56 disposed therein and extended from the base end to the tip end.

The second subcomponent of the butt is the plunger 58. The plunger has a plunging head 60 on one end, a handle 62 on the other end, and a plunging rod 64 extended therebetween. The handle of the plunger is extended from the base end 52 of the butt to a position remote from the butt. A plunging force is adapted to be applied to the handle. The plunging head of the plunger is disposed within the plunger cavity 56 and located at a position adjacent to the seat 38 of the paint cartridge. The plunging head is adapted to deliver the plunging force applied to the handle to the seat 38 of the paint cartridge.

The third subcomponent of the butt is the sealing ring 66. The sealing ring is flexible in structure. The sealing ring is disposed between the plunging head 60 of the plunger and the butt housing 50. The sealing ring is adapted for preventing paint from the paint cartridge 34 from leaking into the plunger cavity 56 when a plunging force is applied to the seat 38.

The fourth subcomponent of the butt is the end cap 68. The end cap is rigid in structure. It is threadably coupled to the base end 52 of the butt housing. It is extended about the plunging rod 64 and allows slidable movement of the plunging rod therethrough. The end cap is adapted for preventing the removal of the plunger 58 from the plunger cavity 56. It is also adapted to serve as a base for maintaining a plunging force upon the seat of the paint cartridge.

The fifth subcomponent of the butt is the spring 70. The spring is disposed within the plunger cavity 56 between the plunging head 60 of the plunger and the end cap 68. The spring is adapted for urging the plunger towards the seat 38 of the paint cartridge.

The third major component is the barrel assembly 72. The barrel assembly includes six subcomponents. The subcomponents are the first barrel, second barrel, barrel adjustment nut, transfer hose, protective sheath, and barrel handle. These subcomponents are interrelated to provide the intended function.

The first subcomponent of the barrel assembly is the first barrel 74. The first barrel has a threaded base end 76 and a threaded tip end 78. The base end is threadably coupled to the tip end 16 of the stock housing. The tip end further includes a rigid stop ring 80 peripherally extended therefrom.

The second subcomponent of the barrel assembly is the second barrel 82. The second barrel is rigid and tubular in structure. It has a base end 84 and a slotted tip end 86. The base end is telescopically received in the tip end 78 of the first barrel.

The third subcomponent of the barrel assembly is the barrel adjustment nut 88. The barrel adjustment nut is threadably coupled to the tip end 78 of the first barrel. It is also disposed about the base end 84 of the second barrel. The barrel adjustment nut includes a coupling ring 90 disposed therein and disposed around the base end of the second barrel. The coupling ring 90 is adapted to expand inwards to secure the second barrel 82 in a fixed position relative to the first barrel 74 when the barrel adjustment nut is tightened against the stop ring 80 of the first barrel.

The fourth subcomponent of the barrel assembly is the transfer hose 92. The transfer hose is flexible in structure. It has a base end 94 coupled to the tip end 46 of the valve assembly. The transfer hose also includes an intermediate portion extended within the first barrel 74 and the second barrel 82. The transfer hose has a tip end 96 projected outwards from the tip end 86 of the second barrel.

The fifth subcomponent of the barrel assembly is the protective sheath 98. The protective sheath is disposed about the transfer hose 92. The sheath has bellows 100 formed thereon for preventing the transfer hose from being kinked and damaged when the second barrel 82 is extended away from the first barrel 74 or when the second barrel is retracted towards the first barrel.

The sixth subcomponent of the barrel assembly is the barrel handle 102. The barrel handle is elongated and rigid in structure. It has a first end coupled to the first barrel 74. It also has a second end with a grip 104 formed thereon. The barrel handle is used to support the barrel when painting.

The fourth major component is the brush 106. The brush includes six subcomponents. The subcomponents are the sash, bristles, first mounting bracket, second mounting bracket, bolt, and wing nut. These subcomponents are interrelated to provide the intended function.

The first subcomponent of the brush is the sash 108. The sash is elongated and rigid in structure. It has a beveled nozzle 110 extended therefrom. The beveled nozzle is coupled to the tip end 96 of the transfer hose. The sash also includes a plurality of generally aligned and spaced supply tubes 112. These supply tubes are extended from the sash in a direction remote from the nozzle. The sash also includes a channel 114 disposed therein between the nozzle and the supply tubes. The channel is adapted for transferring paint from the nozzle to the supply tubes.

The second subcomponent of the brush is the bristles 116. The bristles are extended from the sash 108, disposed around the supply tubes 112, and terminated at a location remote from the sash to define a tapered end 118. The bristles are adapted to contact a surface such as a wall or ceiling and receive paint for painting.

The third subcomponent of the brush is the first mounting bracket 120. The first mounting bracket is rigid in structure. It is coupled to the tip end 86 of the second barrel. The first mounting bracket also includes a mounting hole disposed therethrough.

The fourth subcomponent of the brush is the second mounting bracket 122. The second mounting bracket is rigid in structure. It is coupled to the sash 108 near the nozzle 110. The second mounting bracket also includes a mounting hole disposed therethrough.

The fifth subcomponent of the brush is the bolt 124. The bolt has a threaded portion extended through the mounting hole on the first mounting bracket 120 and mounting hole on the second mounting bracket 122. By disposing the bolt through the brackets, the brackets are thereby placed in a pivotal configuration.

The sixth subcomponent of the brush is the wing nut 126. The wing nut is coupled to the bolt 124 and secures the first mounting bracket 120 to the second mounting bracket 122 at a given position. The wing nut thereby allows the angular orientation of the bristles 116 to be adjusted at a given angle relative to the barrel assembly.

A user may now grip the hand grip 24 and depress the trigger 22. If a plunging force is applied to the handle 62, paint flows from the paint cartridge 34 and through the cartridge receiver 28, valve assembly 42, and transfer hose 92 and sash 108 to wet the bristles 116. Paint on the bristles may then be brushed onto a wall, ceiling, or the like.

The present invention is a gun-type device that is used for "cutting" in a wall. By "cutting" a wall, the edges between adjacent walls and a ceiling of a room are painted. A spray painter or roller may then subsequently be used to paint the larger surfaces between the painted edges. The present invention roughly resembles a long-barreled handgun, and is made mostly of plastic but has a rubber paint feed hose and a metal barrel. The front of the brush bristles is cut at an angle to make it easier and neater for cutting in the walls and ceilings. Three or four plastic paint supply tubes, which are fed by the paint feed hose, are installed about ½ to ¾ inches below the ends of the brush bristles. The brush is connected to the front end of the barrel or tube by an adjustable pivot that can be locked in place by a wing nut. The present invention is designed to be used without a ladder. Its barrel has a length-adjustable telescoping design and is installed in the front end of the unit's housing. The plastic housing contains a rubber feed hose, a valve assembly that is controlled by the trigger, a cartridge receiver, a replaceable paint cartridge that is similar to a caulk cartridge, and a spring that applies pressure to the back of the paint cartridge to dispense the paint. A standard handgrip with a trigger is mounted below the housing, while another handgrip is mounted on the underside of the barrel. The paint feed hose is connected to the cartridge receiver in front of the valve assembly and runs through the barrel to the paint head supply tubes.

The sash-type brush has hollow plastic tubes running through it. These tubes are about ½ inch to ¾ inches long. There are approximately three or four of these supply tubes running through the bristles of the brush. The brush is connected to the adjustable barrel assembly. A wing nut couples the brush to the barrel assembly so that the angle of the paint brush can be changed. The supply hose is disposed through the bracket assembly and is coiled up inside the bracket assembly to allow for adjustment of the barrel assembly. A metal pole is extended from the first barrel for allowing a firm grip of the barrel assembly. The metal pole is about ½ inch in diameter. The paint cartridge is a syringe-like device. The cartridge can be fashioned such that it may be refilled or be disposable. By utilizing the cartridges in the present invention, painting interruption time is minimal. The paint cartridges are adapted to be disposed easily. Empty cartridges can be pulled out of the present invention and placed in a bucket of water for cleaning. When the painting job is completed, the cartridges may be rinsed with water and they are ready to be used again. The present invention is adapted for use with a variety of paints such as latex or oil-based paints. Another advantage of the present invention is that no batteries or other electrical power is required.

To cut in a wall or ceiling with the present invention, one adjusts the angle of the brush head, adjusts the length of the barrel as necessary, places the brush head at the edge to be cut in, and applies steady pressure to the trigger, enabling the paint to be dispensed to the brush and to the surface being painted. The task is accomplished significantly faster, without using a ladder, and with a neater result. The present invention could be of great assistance to painters and paint contractors, saving them time and money. As such, it should be a valuable acquisition for many painters.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A self-loading paint applicator gun for painting the edges between walls and ceilings comprising, in combination:

a stock further comprising:

a rigid and generally tubular stock housing having a threaded base end, a threaded tip end, an elongated and generally tubular cartridge cavity extended from the base end to the tip end, and a linkage cavity extended below the cartridge cavity;

a trigger pivotally coupled to the stock housing near the base end, extended through the linkage cavity, and terminated at a location exterior to the stock housing;

a hand grip extended from the stock housing between the trigger and the base end;

a funnel-shaped cartridge receiver having a radially extended portion disposed in the cartridge cavity and a radially retracted portion disposed in the linkage cavity;

a generally elongated and tubular paint cartridge disposed in the cartridge cavity, the paint cartridge having a hollow and conical tip extended from one end into the cartridge receiver, a seat slidably disposed therein at the other end, and paint disposed therein between the seat and tip with the paint adapted to exit the cartridge from the tip end when a plunging force is applied to the seat;

an elongated valve assembly disposed in the linkage cavity, the valve assembly having a base end and a tip end with the base end coupled to the radially retracted end of the cartridge receiver, the valve assembly further having an opened orientation for allowing the flow of paint through the cartridge receiver and a closed orientation for preventing the flow of paint through the cartridge receiver; and a trigger linkage extended within the linkage cavity between the trigger and the valve assembly with the trigger linkage having one position for placing the valve assembly in the opened orientation when the trigger is depressed towards the hand grip and another position for placing the valve assembly in the closed orientation when the trigger is released;

a butt further comprising:

an elongated and generally tubular butt housing having a threaded base end, a threaded tip end coupled about the base end of the stock housing, and a generally tubular plunger cavity extended from the base end to the tip end;

a plunger having a plunging head on one end, handle on the other end, and a plunging rod therebetween with the handle extended from the base end of the butt housing for applying a plunging force and the plunging head disposed within the plunger cavity for delivering the plunging force to the seat of the paint cartridge;

an end cap threadably coupled to the base end of the butt housing and extended about the plunging rod for preventing the removal of the plunger from the plunger cavity; and a spring disposed within the plunger cavity between the plunging head of the plunger and end cap for urging the plunger towards the seat of the paint cartridge;

a barrel assembly further comprising:

a first barrel having a threaded base end and a threaded tip end with the base end threadably coupled to the tip end of the stock;

a second barrel having a base end and a slotted tip end with the base end telescopically received in the tip end of the first barrel;

a barrel adjustment nut threadably coupled to the tip end of the first barrel and disposed about the base end of the second barrel to secure the second barrel in a fixed position against the first barrel when tightened;

a flexible transfer hose having a base end coupled to the tip end of the valve assembly, an intermediate portion extended within the first barrel and the second barrel, and a tip end extended from the tip end of the second barrel;

a protective sheath disposed about the transfer hose with the sheath having bellows formed thereon for preventing the transfer hose from being kinked and damaged when the second barrel is extended away from the first barrel and retracted towards the first barrel; and a elongated barrel handle having a first end coupled to the first barrel and a second end with a grip formed thereon; and a brush further comprising:

a hollow sash having a beveled nozzle extended therefrom and coupled to the tip end of the transfer hose and a plurality of supply tubes extended therefrom in a direction remote from the nozzle;

a plurality of bristles extended from the sash, disposed around the supply tubes;

coupling means for pivotally coupling the sash to the tip end of the second barrel;

whereby when a plunging force is applied to the plunger, paint from the paint cartridge flows through the cartridge receiver, valve assembly, transfer hose, and sash to wet the bristles for painting.

2. A self-loading paint applicator gun for painting comprising:

a hollow stock having a cartridge cavity formed therein for receiving a paint cartridge filled with paint;

valve means disposed in the stock for engaging a paint cartridge received in the stock, allowing the flow of paint from a paint cartridge in an opened orientation, and preventing the flow of paint from the paint cartridge in a closed orientation;

manually operated trigger linkage means for placing the valve means in the opened orientation and the closed orientation;

a hand grip extended from the stock at a location adjacent to the trigger linkage means for allowing a user a firm grip when actuating the trigger linkage means;

a hollow butt coupled to the stock;

plunging means disposed within the butt for applying a force for allowing paint to flow from the paint cartridge;

a barrel having a base end coupled to the stock and a tip and extended therefrom;

a barrel handle having a first end coupled to the barrel and a second end with a grip formed thereon for holding the barrel in an upwardly extending orientation;

a transfer hose having a base end and tip end with the base end coupled to the valve means; and a brush having a handle on one end coupled to the tip end of the barrel, bristles on the other end, and a hollow and perforated sash therebetween coupled to the tip end of the transfer hose;

whereby when a paint cartridge is disposed in the stock and a plunging force is applied to the plunging means, paint from the paint cartridge flows through the valve means, transfer hose, and sash of the brush to wet the bristles of the brush for painting.

* * * * *